US007318326B2

(12) United States Patent
Lee et al.

(10) Patent No.: US 7,318,326 B2
(45) Date of Patent: Jan. 15, 2008

(54) MULTI-AIR CONDITIONER

(75) Inventors: Yoon-Been Lee, Seoul (KR); Hyung-Soo Kim, Seoul (KR); Sae-Dong Jang, Gyeonggi-Do (KR); Baik-Young Chung, Incheon (KR); Sai-Kee Oh, Seoul (KR); Kyung-Won Seo, Seoul (KR); Ho-Jong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 364 days.

(21) Appl. No.: 10/984,970

(22) Filed: Nov. 10, 2004

(65) Prior Publication Data

US 2005/0257565 A1 Nov. 24, 2005

(30) Foreign Application Priority Data

May 24, 2004 (KR) ..... 10-2004-0037009

(51) Int. Cl.
*F25B 1/10* (2006.01)

(52) U.S. Cl. ..... 62/510

(58) Field of Classification Search ..... 62/175, 62/510

See application file for complete search history.

(56) References Cited

U.S. PATENT DOCUMENTS

| | | | |
|---|---|---|---|
| 4,878,357 | A | 11/1989 | Sekigami |
| 5,279,131 | A | 1/1994 | Urushihata et al. |
| 5,490,399 | A | 2/1996 | Sada |
| 5,526,777 | A | 6/1996 | Taomo |
| 5,548,968 | A | 8/1996 | Sada |
| 6,735,973 | B2 | 5/2004 | Lee |
| 6,772,600 | B2 | 8/2004 | Hwang |
| 2005/0081540 | A1 | 4/2005 | Hwang |

FOREIGN PATENT DOCUMENTS

| | | |
|---|---|---|
| EP | 0638777 | 2/1995 |
| EP | 0639745 | 2/1995 |
| EP | 1526346 | 4/2005 |
| JP | 1-247967 | 10/1989 |
| JP | 8-200868 | 8/1996 |
| JP | 11-083223 | 3/1999 |

OTHER PUBLICATIONS

English language Abstract of JP 8-200868.
English language Abstract of JP 11-083223.
U.S. Appl. No. 10/929,456 Nahm Hwang et al.
English Language Abstract of JP 1-247967.

*Primary Examiner*—Melvin Jones
(74) *Attorney, Agent, or Firm*—Greenblum & Bernstein, P.L.C.

(57) ABSTRACT

A multi-air conditioner comprising: a plurality of indoor units for exchanging the heat with indoor air; a plurality of outdoor units, each outdoor unit having an outdoor heat exchanger for exchanging the heat and a compressor for compressing a fluid; a connecting pipe for connecting the indoor units with the outdoor units; and a pressure equalizing pipe for communicating the outdoor heat exchanger of one outdoor unit with the compressor of at least one other outdoor unit, so that the multi-air conditioner is capable of improving stability, reliability and efficiency of a system by equalizing the low pressure between the indoor units in heating and equalizing the high pressure between the outdoor units in cooling.

14 Claims, 5 Drawing Sheets

MULTI-AIR CONDITIONER

BACKGROUND OF THE INVENTION

1. Field of the Invention

The present invention relates to a multi-air conditioner having a plurality of outdoor units and indoor units, and more particularly, to a multi-air conditioner which enables to equally distribute a refrigerant and oil by providing a pressure equalizing pipe for connecting the outdoor units and improves operational stability, reliability and efficiency by equally using components of the outdoor units.

2. Description of the Background Art

As for general air-conditioners, there is what is called a heat pump or an air conditioner for four seasons which is designed to allow the flow of a refrigerant to be reversed and thus capable of both cooling and heating.

Meanwhile, a multi-air conditioner is provided with indoor units respectively disposed at a plurality of indoor spaces and with a plurality of outdoor units generally in order to effectively cope with a partial load meaning that only some of the indoor units are operated. Researches have been made with regard to connection structures of refrigerant conveying conduits in such a plurality of indoor units and outdoor units. As one example, a multi-air conditioner provided with a pressure equalizing pipe connecting between the outdoor units is disclosed in U.S. Pat. No. 5,279,131. FIGS. 1 and 2 show an air conditioner disclosed in U.S. Pat. No. 5,279,131.

Firstly, as shown in FIG. 1, the conventional multi-air conditioner is provided with a plurality of indoor units 2A, 2B, 2C and 2D and a plurality of outdoor units 1A and 1B. Each of indoor units 2A, 2B, 2C and 2D is provided with a liquefied refrigerant conduit $\mathbf{3}_2$ and a gasified refrigerant conduit $\mathbf{4}_2$. The liquefied refrigerant conduit $\mathbf{3}_2$ and the gasified refrigerant conduit $\mathbf{4}_2$ are connected with a liquefied refrigerant conduit $\mathbf{3}_1$ and a gasified refrigerant conduit $\mathbf{3}_2$ which are provided to a plurality of outdoor units 1A and 1B, respectively. The outdoor units 1A and 1B are connected together by means of a pressure equalizing pipe 9 and an oil equalizing pipe 10 in order to prevent imbalances of oil fed to compressors of the respective outdoor units 1A and 1B.

FIG. 2 is an enlarged view showing a connection relationship between the conventional outdoor units. As shown therein, a compressor 11 of the outdoor unit 1A is connected with an oil separator through a discharge pipe 20. The oil separated in the oil separator 21 returns to the compressor 11 through an oil returning pipe 22 connected with the compressor. The other outdoor unit 1B has the same structure as this. The pressure equalizing pipe 9 and the oil equalizing pipe 10 are connected between the oil separators 21 of each of outdoor units 1A and 1B to prevent imbalances of oil between the compressors 11.

An operation of such conventional multi-air conditioner is as follows.

In a cooling operation, a refrigerant takes indoor heat away from the indoor units 2A, 2B, 2C and 2D including indoor exchangers and moves to the outdoor units 1A and 1B through the liquefied refrigerant conduit 3 and the gasified refrigerant conduit 4. At this time, the refrigerant keeps low-pressure. The pressure of the refrigerant is increased in the compressors 11 provided to the outdoor units and so the high-pressure refrigerant exchanges the heat with the outdoor in the heat exchangers (not shown) of the outdoor units. After that, the pressure of the refrigerant drops in an expansion valve (not shown) and thus the refrigerant becomes low-pressure again. The low-pressure refrigerant circulates again to the indoor units.

In a heating operation, a refrigerant having emitted the heat to the indoor in the indoor exchangers moves to the outdoor units 1A and 1B, keeping high-pressure. The refrigerant which has become low-pressure in the expansion valve (not shown) exchanges the heat with the outdoor in the heat exchangers of the outdoor units 1A an 1B, and then moves to the compressor 11. The refrigerant whose pressure is increased circulates again to the indoor units.

Since the conventional multi-air conditioner in which the pressure equalizing conduit 9 and the oil equalizing conduit 10 communicate with each other between the oil separators 21 of the outdoor units 1A and 1B serves only to equalize the pressure of the high-pressure refrigerant in cooling/heating, it has problems as follows.

Firstly, in the heating operation, efficiency of a system is decreased due to uneven frosting since differences occur where the refrigerant becomes low-pressure between the outdoor units. In addition, in case there is a difference in a capacity of the compressors of the outdoor units or there are outdoor units in which compressors are not operated, operational stability and reliability of a system are decreased due to unequal distribution of the refrigerant and the oil.

Moreover, the pressure of the refrigerant is sharply increased where the refrigerant becomes high-pressure in the outdoor units being operated in the cooling operation, which may cause a damage to the compressors.

In addition, when some of the outdoor units are operated in both cooling and heating, elements being operated can be overloaded, and besides components cannot be evenly used.

SUMMARY OF THE INVENTION

Therefore, an object of the present invention is to provide a multi-air conditioner which enables to equally distributing a refrigerant and oil by providing a pressure equalizing pipe for connecting outdoor units and improve operational stability, reliability and efficiency of a system by evenly using components of the outdoor units.

To achieve these and other advantages and in accordance with the purpose of the present invention, as embodied and broadly described herein, there is provided a multi-air conditioner comprising: a plurality of indoor units for exchanging the heat with indoor air; a plurality of outdoor units, each outdoor unit having an outdoor heat exchanger for exchanging the heat and a compressor for compressing a fluid; a connecting pipe for connecting the indoor units with the outdoor units; and a pressure equalizing pipe for communicating the outdoor heat exchanger of one outdoor unit with the compressor of at least one other outdoor unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
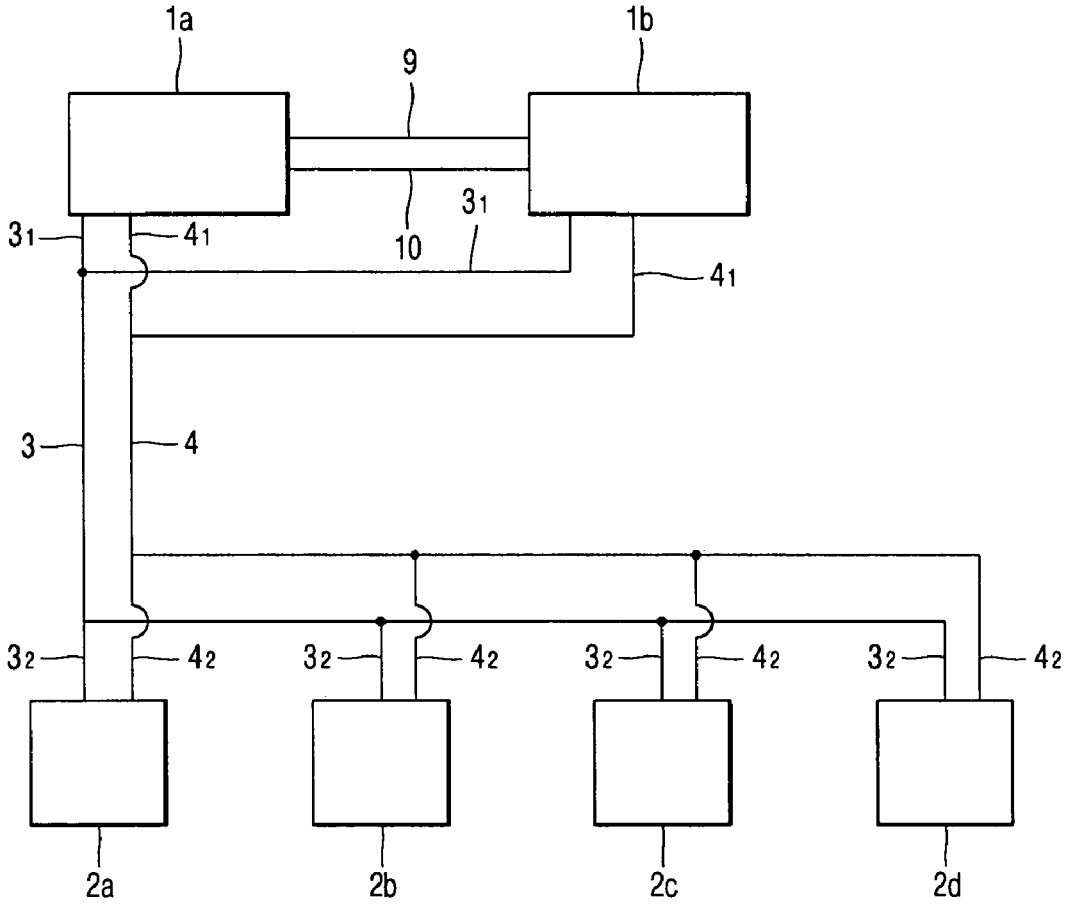
FIG. 1 PRIOR ART
FIG. 1 is a construction view showing a connection relationship between the conventional outdoor units.
Figure 2:
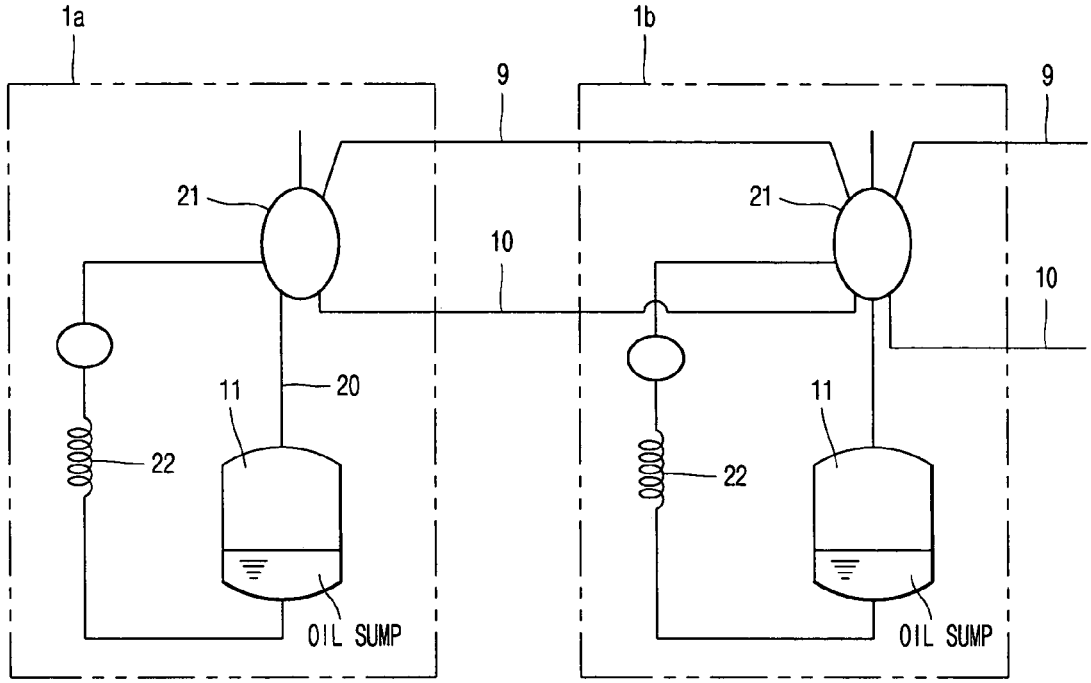
FIG. 2 PRIOR ART
FIG. 2 is an enlarged construction view showing the connection relationship between the conventional outdoor units.
Figure 3:
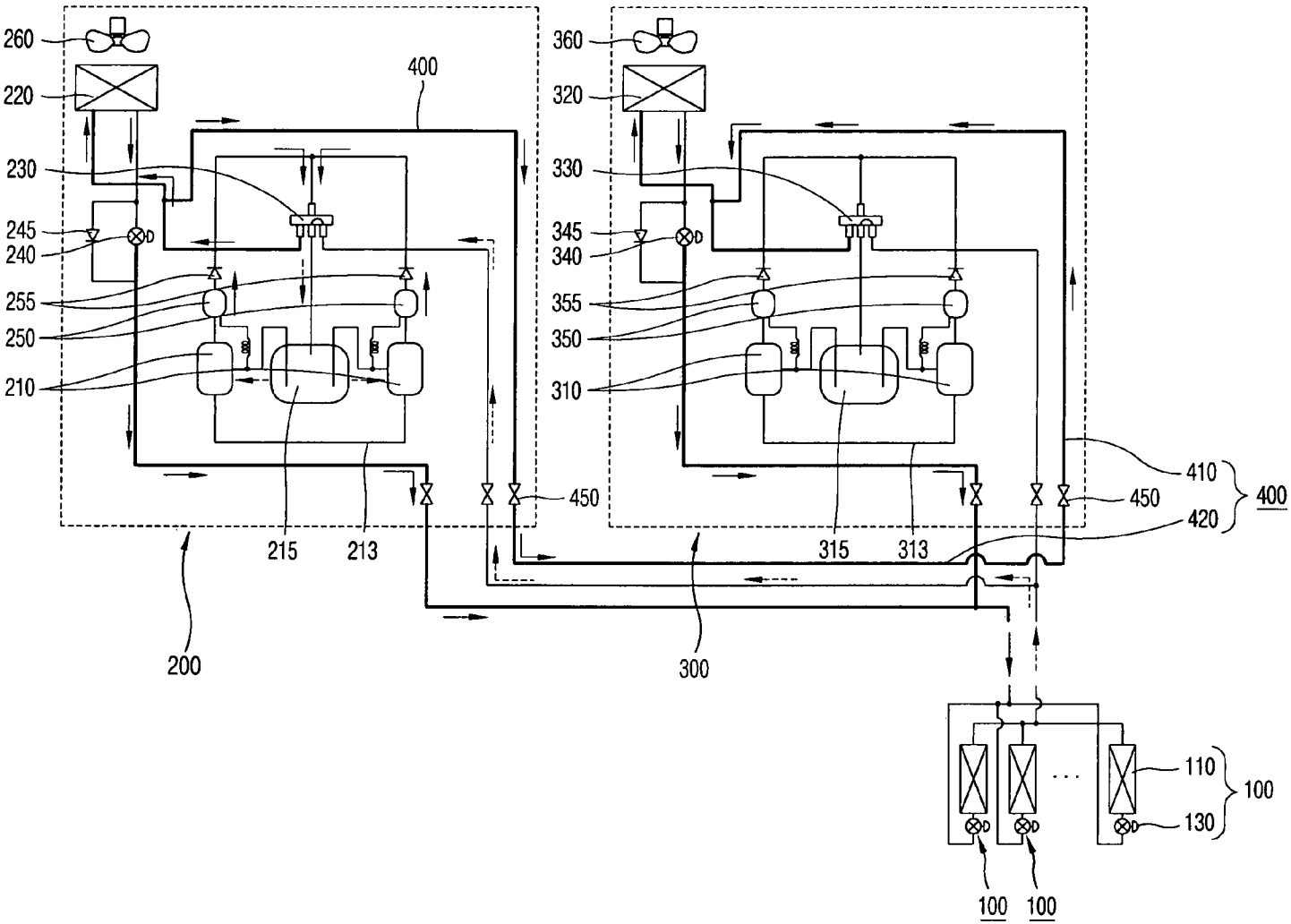
FIG. 3 is a construction view illustrating the flow of a fluid in cooling of a multi-air conditioner in accordance with the present invention.

FIG. 3 is a construction view of a multi-air conditioner in accordance with an embodiment of the present invention.

As shown therein, the multi-air conditioner in accordance with the present invention comprises: a plurality of indoor units 100 for exchanging the heat with indoor air; a plurality of outdoor units 200 and 300, each outdoor unit having an outdoor heat exchanger 220 for exchanging the heat and a compressor 210 for compressing a fluid; a connecting pipe for connecting the indoor units 100 with the outdoor units 200 and 300; and a pressure equalizing pipe 400 for communicating the outdoor heat exchanger 220 of one outdoor unit with the compressors 210 of at least one other outdoor unit.

The each indoor unit 100 include: an indoor heat exchanger 110 disposed at an indoor space and exchanging the heat with indoor air; and an indoor expansion valve 130 disposed to be connected with the indoor heat exchanger 110 and changing a fluid into low pressure low temperature.

The outdoor units 200 include: a plurality of compressors 210 for compressing the fluid and changing the compressed fluid into high temperature high pressure; an accumulator 215 for separating the fluid supplied to the compressors 210 into a gas and a liquid; a 4-way valve 230 disposed at a discharge side of a plurality of compressors 210 and switching a flow channel of the fluid; an outdoor heat exchanger 220 connected with the 4-way valve 230 and exchanging the heat with the outdoor; and an outdoor expansion valve 240 connected with the outdoor heat exchanger 220 and changing the fluid into low temperature low pressure.

A plurality of compressors 210 are connected to communicate with an oil equalizing pipe 213 in order to properly distribute oil for each compressor, and oil separators 250 for separating the oil included in a refrigerant discharged from the compressors 210 and supplying the oil to an inlet side of the compressors 210. Along a flow direction of the fluid, check valves 255 are provided to the lower oil separators 250, respectively, preventing a backflow of the refrigerant.

The accumulator 215 is connected to the inlet side of the compressors 210, and provides a gaseous fluid alone to the compressors and returns a liquid fluid to the accumulator 215.

The 4-way valve 230 is connected with the outdoor heat exchanger 220, the accumulator 215 and the indoor units 100 in addition to the discharge side of the compressors 210, and changes a flow direction of the fluid according to cooling or heating.

The outdoor heat exchanger 220 is provided with an outdoor unit fan 260 for better heat exchanging. The outdoor heat exchanger 220 has one side provided with the check valve 245 and the outdoor expansion valve 240, and is connected with the indoor units 100.

In heating, the fluid passes through the outdoor expansion valve 240 is changed into low temperature low pressure, whereas in cooling, the fluid makes a detour toward the check valve 245.

The other outdoor unit 300 has the same construction as the above.

The pressure equalizing unit 400 includes: an inner piping part 410 having an end portion of one side which is connected to piping for connecting the 4-way valve 230 with the outdoor heat exchanger 220 and disposed in each of outdoor units 200 and 300; and a connecting piping part 420 connected to communicate with each of other ends of the inner piping part 410 to make the outdoor units 200 and 300 communicate with each other.

Each of inner piping part 410 has opening/closing valves 450 for opening/closing a flow channel, and each of opening/closing valves is mainly in a state of being opened after installation.

There can be a plurality of pressure equalizing pipes 400.

As for the pressure equalizing pipe 400, piping for connecting the 4-way valve 230 with the outdoor heat exchangers 220 of the outdoor units is preferably positioned to connect the outdoor units 200 and 300 to each other, like the embodiment of the present invention.

In addition, in the pressure equalizing pipe 400, piping for connecting the 4-way valve 230 with the compressors 210 of the outdoor units can be positioned to connect the outdoor units 200 and 300 to each other.

Preferably, the multi-air conditioner of the present invention further comprises a control unit for controlling the expansion valve and the outdoor unit fan of at least one among the outdoor units in which compressors are not operated.

Figure 4:
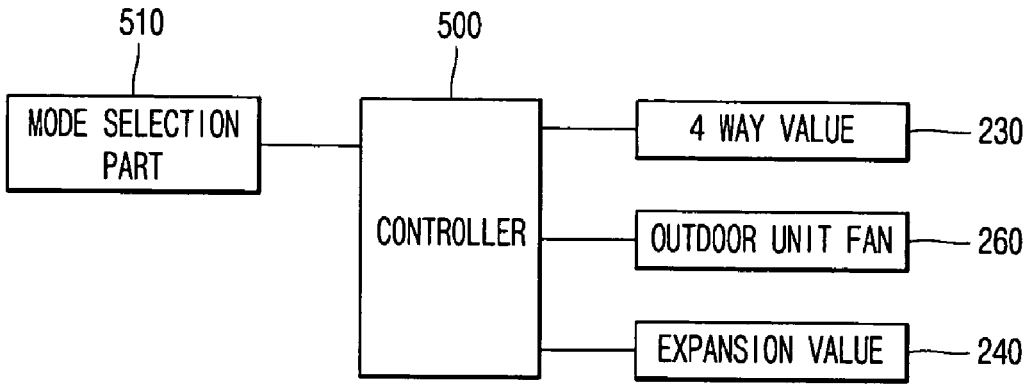
FIG. 4 is a control block diagram of the multi-conditioner in accordance with the present invention.

FIG. 4 is a control block diagram of the multi-air conditioner in accordance with the present invention.

As shown in FIG. 4, the control unit includes: a mode selection part 510 for selecting one from a cooling operation and a heating operation; a controller 500 receiving a signal of the mode selection part 510 and executing a control program; and a connection means for transmitting electric signals to the 4-way valve 230, the outdoor unit fan 260 and the expansion valve 240, respectively according to the signal of the controller 500.

The controller 500 is made up of a microprocessor, or the like, has the control program, and selectively operates the 4-way valve 230, the outdoor unit fan 260 and the expansion valve 240 according to the selected mode. According to modes, the controller changes a flow direction of the fluid by changing the flow channel of the 4-way valve, or operates the outdoor unit fan and the expansion valve of the outdoor units which are not operated when the compressors of some outdoor units are operated.

Hereinafter, an operation effect of the present invention is described as follows.

Firstly, with reference to FIG. 3, as for the cooling operation, the refrigerant carrying out the heat exchanging in the indoor units 100 passes through the 4-way valve 230. At this time, in the control unit, the flow channel of the 4-way vale 230 is controlled and the fluid is made to flow in the accumulator 215. A gaseous fluid from the fluid having flowed in the accumulator 215 is supplied to the compressors 210 and a liquid fluid returns to the accumulator 215. The gaseous fluid having compressed at the compressors 210 flows toward the corresponding outdoor heat exchanger 220 through the 4-way valve 230. At this time, a part of the fluid diverges and along the pressure equalizing pipe 400, it is mixed with the fluid flowing toward the outdoor heat exchanger 320 of the other outdoor unit 300, thereby equalizing the pressure. The refrigerants having exchanged the heat by passing through each of the outdoor heat exchangers 220 and 320 get together to flow to the indoor units 100 being operated, and flow to the 4-way valve 230 of the outdoor units being operated after carrying out the cooling action in each of the indoor heat exchangers 110. Repeating such a process carries out the cooling action. At this time, a pipe in which the high-pressure fluid flows is marked by a thick line in FIG. 3. As shown therein, in the cooling operation, the pressure equalizing pipe 400 serves to equalize the high pressure.

A case that some of the outdoor units are operated is as follows. For convenience of description, let us suppose that the compressors 210 are all operated in the left outdoor unit 200, and the compressors 310 are not operated in the right outdoor unit 300. When only some of a plurality of indoor units are operated, some of the outdoor units are not operated often. The flow of the fluid regarding this is shown with arrows in FIG. 3. As shown therein, the fluid having exchanged the heat in the indoor units 100 passes through the compressors 210 of the outdoor unit 200 in which the compressors 210 are operated by the 4-way valve 230 and flows to the outdoor heat exchanger 220. At this time, a part of the fluid diverges and along the pressure equalizing unit 400, it is mixed with the fluid flowing toward the outdoor heat exchanger 320 of the outdoor unit 300 in which the compressors 310 are not operated, thereby equalizing the high pressure. The control unit makes the outdoor unit fan 360 of the outdoor unit 300 in which the compressors are not operated rotated.

Figure 5:
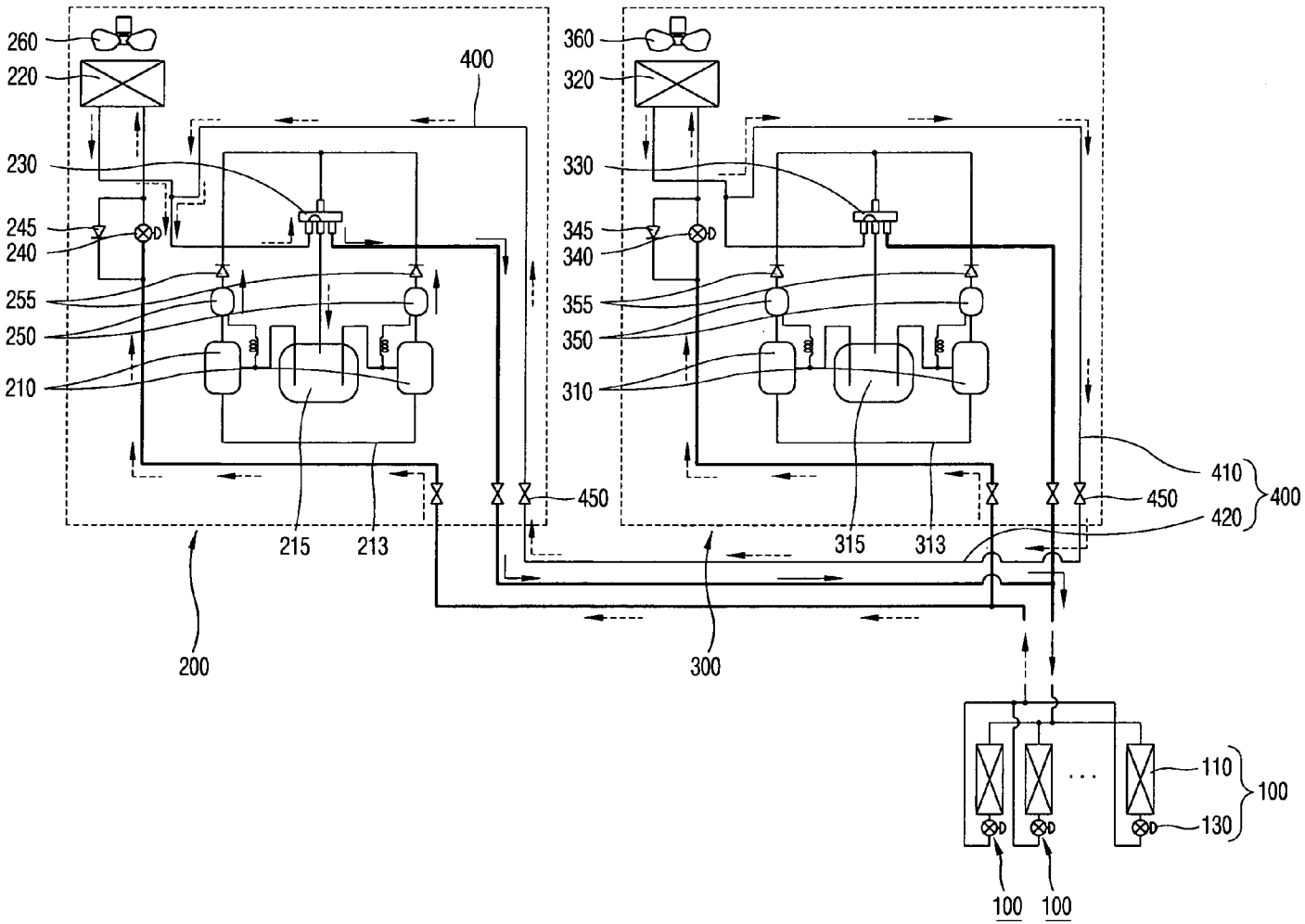
FIG. 5 is a construction view showing the flow of a fluid in heating of the multi-air conditioner in accordance with the present invention.

Next, the heating operation is as follows, referring to FIG. 5. Like FIG. 3, a pipe in which the high-pressure fluid flows is marked by a thick line in FIG. 5. The fluid having carried out the heat exchanging in the indoor units 100 is decompressed and expanded, passing through the expansion valve 240, and absorbs a latent heat to be evaporated, passing through the corresponding outdoor heat exchanger 220. After that, the fluid passes through the 4-way valve 230. At this time, a part of the fluid diverges and along the pressure equalizing pipe 400, it is mixed with the fluid flowing toward the 4-way valve 230 of the other outdoor unit 300, thereby equalizing the low pressure. By controlling the 4-way valve 230, the fluid having passed through the 4-way valve 230 flows into the compressors 210 through the accumulator 215. The fluid discharged from the compressors 210 passes through the 4-way valve 230 again and flows to the indoor unit 100 being operated. Repeating such a process carries out the heating. If some of the outdoor units are operated, as the flow of the fluid is shown with arrows in FIG. 5, a part of the fluid diverges and along the pressure equalizing pipe 400, it is mixed with the fluid flowing toward the 4-way valve 330 of the outdoor unit 300 in which the compressors are not operated. At this time, the control unit controls an opening of the expansion valve 320 of the outdoor unit 300 which is not operated, and makes the outdoor unit fan 360 rotated.

In the above-described embodiment, two outdoor units are constructed, and the opening/closing valves for opening/closing the pressure equalizing pipe are installed to open/close the inner piping unit of each of the outdoor units and are mainly in a state of being opened after installation of each of the outdoor units. However, it is also possible that in case of more than three outdoor units, the opening/closing valves are constructed as electric ones which are opened/closed by an electric power in each inner piping part, and in case there are a plurality of outdoor units in which compressors are not operated, taking the amount of cooling load and power consumption into accounts, the control unit selectively controls the electric valves in order that a refrigerant flows to the outdoor heat exchanger in some of the outdoor units of which the compressors are not operated and the refrigerant does not flow in others.

In the embodiment, the air conditioner in which each of outdoor units is provided with the 4-way valve for switching the flow channel of the fluid is taken as an example, but it goes without saying that the present invention can be applied to an air conditioner not provided with the 4-way valve.

As described so far, the multi-air conditioner in accordance with the present invention is capable of preventing efficiency degradation of a system due to uneven frosting by equalizing the pressure between where the pressure of the refrigerant becomes low-pressure in the outdoor units in the heating operation.

In addition, when there occurs a difference in a capacity of the compressors between the outdoor units or there are outdoor units of which compressors are not operated, operational stability and reliability of a system can be secured by equally distributing a refrigerant and oil.

Moreover, by equalizing high pressure of the outdoor units which are operated in a cooling operation, the pressure is sharply increased to prevent a damage to the compressors.

Further, when some of the outdoor units are operated in both cooling and heating, efficiency of the system can be raised by evenly using components.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A multi-air conditioner comprising:

a plurality of indoor units that exchange heat with indoor air;

a plurality of outdoor units, each outdoor unit having an outdoor heat exchanger that exchanges heat, a compressor that compresses a fluid, and a 4-way valve that communicates with the compressor and switches a flow channel of the fluid;

a connecting pipe that connects the indoor units with the outdoor units; and a pressure equalizing pipe that communicates an outdoor heat exchanger of one outdoor unit with a compressor of at least one other outdoor unit, wherein the pressure equalizing pipe connects a portion between a 4-way valve and a compressor of one outdoor unit with a portion between a 4-way valve and a compressor of at least one other outdoor unit.

2. The multi-air conditioner of claim 1, wherein the pressure equalizing pipe comprises:

an inner piping part disposed in the outdoor units; and a connecting piping part connected to ends of the inner piping part to allow the outdoor units to communicate with each other.

3. The multi-air conditioner of claim 1, wherein each indoor unit comprises:

an indoor heat exchanger disposed at an indoor space that exchanges heat with indoor air; and an indoor expansion valve disposed to be connected with the indoor heat exchanger that reduces the pressure and temperature of the fluid.

4. The multi-air conditioner of claim 1, wherein each outdoor unit further comprises:

an accumulator that separates fluid supplied to the compressor into a gas and a liquid; and an outdoor expansion valve connected with the outdoor heat exchanger that reduces the temperature and pressure of the fluid.

5. The multi-air conditioner of claim 1, wherein each 4-way valve is connected to an outdoor heat exchanger.

6. The multi-air conditioner of claim 1, wherein each outdoor unit has at least two compressors.

7. The multi-air conditioner of claim 6, wherein the compressors of each outdoor unit communicate with an oil equalizing pipe that distributes oil.

8. The multi-air conditioner of claim 7, further comprising:

oil separators connected with a discharge side of the compressors that separate oil included in a discharged fluid and supply the separated oil to an inlet side of the compressors.

9. The multi-air conditioner of claim 8, further comprising:

check valves that prevent a backflow of refrigerant in the oil separators.

10. The multi-air conditioner of claim 1, further comprising:

an accumulator connected to an inlet side of the compressors, that provides a gaseous fluid to the compressors and returns a liquid fluid.

11. The multi-air conditioner of claim 1, further comprising:

a control unit that controls an expansion valve and an outdoor unit fan of at least one of the outdoor units in which compressors are not operated.

12. The multi-air conditioner of claim 1, further comprising:

opening/closing valves in the pressure equalizing pipe that open and close the pressure equalizing pipe.

13. The multi-air conditioner of claim 12, wherein the opening/closing valves are electric valves and comprise a control unit.

14. A multi-air conditioner comprising:

a plurality of indoor units that exchange heat with indoor air;

a plurality of outdoor units, each outdoor unit being provided with an outdoor heat exchanger that exchanges heat with outdoor air, a compressor that compresses a fluid, and a 4-way valve that communicates with the compressor and switches a flow channel of the fluid;

a connecting pipe that connects the indoor units with the outdoor units; and a plurality of pressure equalizing pipes that connect piping that connect the outdoor heat exchangers with the compressors of the outdoor units to allow the outdoor units to communicate with each other, wherein the pressure equalizing pipes connect a portion between a 4-way valve and a compressor of one outdoor unit with a portion between a 4-way valve and a compressor of at least one other outdoor unit.

* * * * *